US005943721A

United States Patent [19]

Lerette et al.

[11] Patent Number: 5,943,721

[45] Date of Patent: Aug. 31, 1999

[54] LIQUIFIED GAS DRY CLEANING SYSTEM

[75] Inventors: Ricky D. Lerette, Stoughton; Maurice O. LeBlanc, Acushnet; George A. Silvia, Westport, all of Mass.

[73] Assignee: American Dryer Corporation, Fall River, Mass.

[21] Appl. No.: 09/075,958

[22] Filed: May 12, 1998

[51] Int. Cl.[6] ..... D06F 43/02; D06F 43/08

[52] U.S. Cl. ..... 8/158; 8/159; 68/18 C; 68/139; 68/140

[58] Field of Search ..... 8/158, 159; 68/5 C, 68/18 R, 18 C, 24, 140; 277/401

[56] References Cited

U.S. PATENT DOCUMENTS

| | | | |
|---|---|---|---|
| 2,528,594 | 11/1950 | Kahn | 68/140 X |
| 3,410,118 | 11/1968 | Dickey | 68/140 X |
| 3,613,406 | 10/1971 | Toth | 68/140 |
| 4,012,194 | 3/1977 | Maffei | 8/142 |
| 4,708,711 | 11/1987 | Scherer | 277/401 |
| 5,267,455 | 12/1993 | Dewees et al. | 68/5 C |
| 5,279,615 | 1/1994 | Mitchell et al. | 8/142 |
| 5,412,958 | 5/1995 | Iliff et al. | 68/5 C |
| 5,467,492 | 11/1995 | Chao et al. | 8/159 |

OTHER PUBLICATIONS

Jun. 1996 Chesterton Brochure on 225 Cartridge Dual Seal (4 pages).

Chesterton Drawing Form No. SPDO29 dated May 27, 1994.

*Primary Examiner*—Philip R. Coe

*Attorney, Agent, or Firm*—Pollock, Vande Sande & Amernick, R.L.L.P.

[57] ABSTRACT

A system and method for cleaning an article with cleaning fluid comprising a liquified gas, preferably carbon dioxide, maintained at a pressure elevated above atmospheric pressure in the wash chamber of a pressure vessel. A basket holding the article is rotated in the wash chamber by a drive shaft passing through a wall of the pressure vessel, and a seal mechanism for this passage prevents escape of the cleaning fluid. The seal mechanism includes a first seal component adjacent to the wash chamber and a second seal component outboard of the first seal component to provide a sealant chamber in which a pressurized sealant fluid is provided such that a pressure differential across the first seal component is substantially less than the pressure differential between the wash chamber and atmospheric pressure The sealant fluid may be a gaseous component or a liquid component of the cleaning fluid. Fluid and control systems are provided for automating washing, rinsing and sealing operations.

21 Claims, 9 Drawing Sheets

5
5
6
6
WV
-22-
M5
28
26
24
20
18
19
38
39
40
41
14
16
75
12
N5
N8
75
LR
76
62
60
58
42
48
Z
46
44
36
N9
N6
N1
N3
68
69
73
70
64
72
LP
66
50
34
N2
N7
33
N4
32

L31
M2
SV7
L22
SV8
L44
L29
PA6
CV2
SV15
L30
P4
SV14
MV13
L34
SV9
LL4
MV12
MV16
RV5
CV3
WT
SV29
DP4
L40
CV7
LL3
PA5
LL5
DT
MV9
P3
TA7
NV1
SV35
P5
DP3
RV4
HX4
L42
DP5
TT
SV34
TA5
TA8
L41
T5
HX3
T4
CT
PS4
MV18
TA6
RT
T3
SV39
M4
MV34
CV10
WW
L26
CV1
SV12
PS3
L33
MV10
SV16
SV31
SV11
CV6
SV40
L35
L27
SV13
MV30
MV14
SV38
SV10
L36
SV17
L37
L38
SW
L28
MV1
L7
SV6
M3
L25
F1
SV28
L43

LIQUIFIED GAS DRY CLEANING SYSTEM

FIELD OF THE INVENTION

This invention relates generally to dry cleaning systems, and more particularly to an improved dry cleaning system that employs liquified gas as a cleaning fluid, is energy efficient, and minimizes cleaning fluid loss.

BACKGROUND OF THE INVENTION

In conventional dry cleaning machines, articles soiled with dirt, stains and other contaminants are put into a cylindrical basket mounted for rotation inside the cleaning chamber through its door, after which the door is closed to seal the chamber. The sealed chamber is then partially filled with a hydrocarbon cleaning fluid or "solvent". The articles and fluid are tumbled together by rotating the basket or "tumbler" so that the solvent is brought into intimate contact with the surfaces of the article and is absorbed by the absorbent portions thereof to dissolve or suspend contaminants so that they are removed from the articles. The solvent may be continuously filtered and recirculated to the cleaning chamber to remove suspended but undissolved solid contaminants. After the cleaning cycle, the solvent is drained from the cleaning chamber and may be filtered and reused, provided that the level of dissolved contaminants is not approaching saturation.

It is now recognized that such conventional dry cleaning machines and methods involve significant health and environmental risks because of the toxic nature of conventional hydrocarbon cleaning fluids. Because carbon dioxide is an environmentally safe gas present in ambient air, its efficient use as a dry cleaning fluid would avoid many of the environmental and health problems associated with conventional cleaning fluids.

Efforts have been made in the past to develop dry cleaning systems in which clothing is contacted with chilled liquid carbon dioxide for the purpose of removing contaminants from the garments. Such prior art systems contemplate converting the carbon dioxide from its liquid state to its gaseous state in an evaporator so as to leave behind the contaminants. The gas is then condensed back to liquid carbon dioxide, which is recycled to the cleaning chamber.

However, keeping carbon dioxide in its liquid state requires that the cleaning chamber be at a relatively high pressure in a pressure vessel. This requirement has made it difficult to agitate the clothing sufficiently to achieve efficient and cost effective cleaning operations. For example, prior art devices have been unable to use the rotating tumbler of conventional dry cleaning machines because of difficulties in preventing high pressure carbon dioxide from escaping around the drive shaft connected to the tumbler through a wall of the pressure vessel. Suggested alternatives, such as rotating a basket or other agitator through a magnetic coupling, have been found to be relatively ineffective, especially for commercial size units.

Accordingly, a real need exists for a liquid carbon dioxide dry cleaning system that is efficient and capable of providing effective agitation of the articles to be cleaned and the pressurized cleaning medium without significant loss of the medium from the pressure vessel. The efficiency of such a system also requires minimizing the amount of carbon dioxide expended during the cleaning operations by maximizing the amount recovered and reused after each washing and rinsing cycle.

SUMMARY OF THE INVENTION

The present invention satisfies the foregoing needs and requirements by providing an improved system for cleaning contaminated articles with an environmentally safe cleaning fluid, preferably a liquid carbon dioxide solvent and a co-solvent additive. The system includes a pressurized wash vessel containing a tumbler basket for holding the articles that is rotated to agitate both the articles and the cleaning fluid in the presence of each other.

A drive shaft for rotating the basket penetrates a pressure vessel wall and this penetration is sealed by a special seal mechanism utilizing a pressurized fluid sealant to minimize the loss of cleaning fluid through the pressure vessel penetration. The sealant also may be used to lubricate relatively moving seal elements. The seal means for the tumbler shaft may include a special holding tank for a sealant used for both lubricating seal elements and pressurizing a sealant chamber of the seal means.

The system also comprises at least one storage vessel for storing the solvent, at least one storage vessel for storing the co-solvent, a distillation tank for vaporizing the solvent to separate it from dissolved and suspended contaminants and from the co-solvent, means for condensing and recycling the evaporated solvent, and a rinse fluid tank for recovering and re-using the cleaning fluid used in a rinse cycle following a wash cycle. A compressor is used to maximize the recovery of gaseous solvent before the wash vessel is opened to ambient pressure after completion of a wash operation, which may consist of a wash cycle alone or consecutive wash and rinse cycles.

The system uses a plurality of solenoid valves, an automated compressor and several automated pumps. A locking ring and locking pin for securing the wash vessel door are operated hydraulically, so that the cleaning system is especially adapted for automatic operation by a microprocessor. Such automation facilitates an efficient and cost effective operation of the system, and minimizes the personnel required for system operation.

BRIEF DESCRIPTION OF THE DRAWINGS

The invention, especially its structure, operation and advantages, may be further understood by reference to the detailed description below taken in conjunction with the accompanying drawings in which.

DETAIL DESCRIPTION OF THE INVENTION

Figure 1:
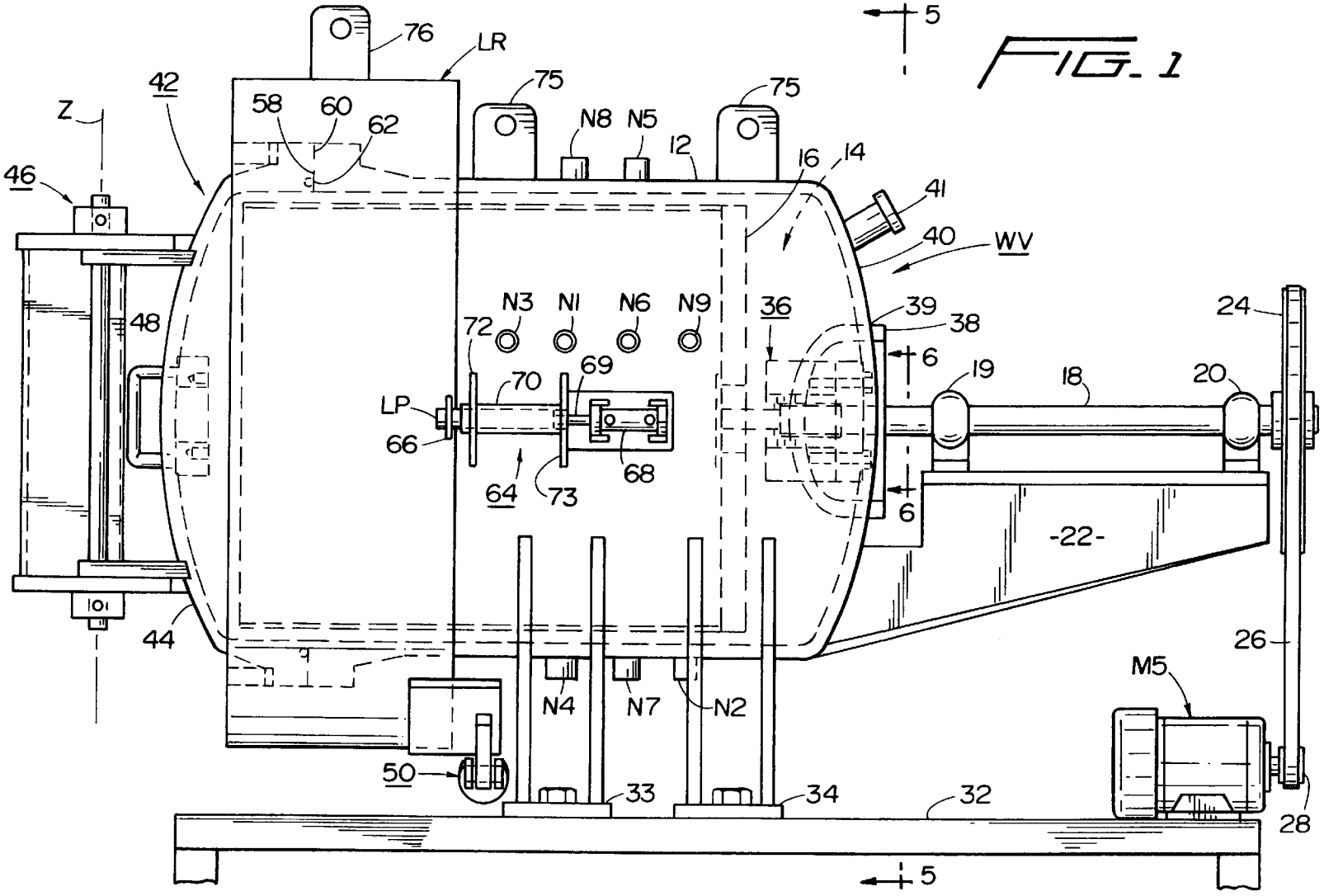
FIG. 1 is an side elevational view of the wash vessel of the invention.

In FIG. 1, there is shown a wash vessel WV that is particularly suited for cleaning fabric articles, such as clothing, with liquid carbon dioxide ($CO_2$). The wash vessel is a pressure vessel having an outer cylindrical sidewall 12 around an interior cleaning chamber 14 containing a perforated basket 16 mounted for rotation on a drive shaft 18 rotatably supported in a pair of bearings 19, 20 fixed to the upper surface of a platform 22 mounted on an end wall 40 of the wash vessel- The outer end of drive shaft 18 carries a driven pulley 24 that is arranged to be driven in rotation by a belt 26 passing around a drive pulley 28 on the shaft of a motor M5 mounted on a base 32. Also mounted on the base 32 by means of a pair of dual brackets 33, 34 is the wash vessel WV. The inner end of the drive shaft 18 is connected to the tumbler basket 16 after passing through a seal assembly 36, which will be described in more detail below. The seal assembly 36 is rigidly mounted in an inverted head piece 38 welded in an opening 39 in the hemispherical rear end wall 40 of the wash vessel.

The sidewall 12 of the wash vessel defines an opening opposite to end wall 40 that is closed by a door assembly 42 comprising a hemispherical head 44 mounted for pivotal swinging movement around a vertical axis Z by a hinge assembly 46. The door 44 may be swung manually by gripping an outwardly projecting handle 48.

Figure 2:
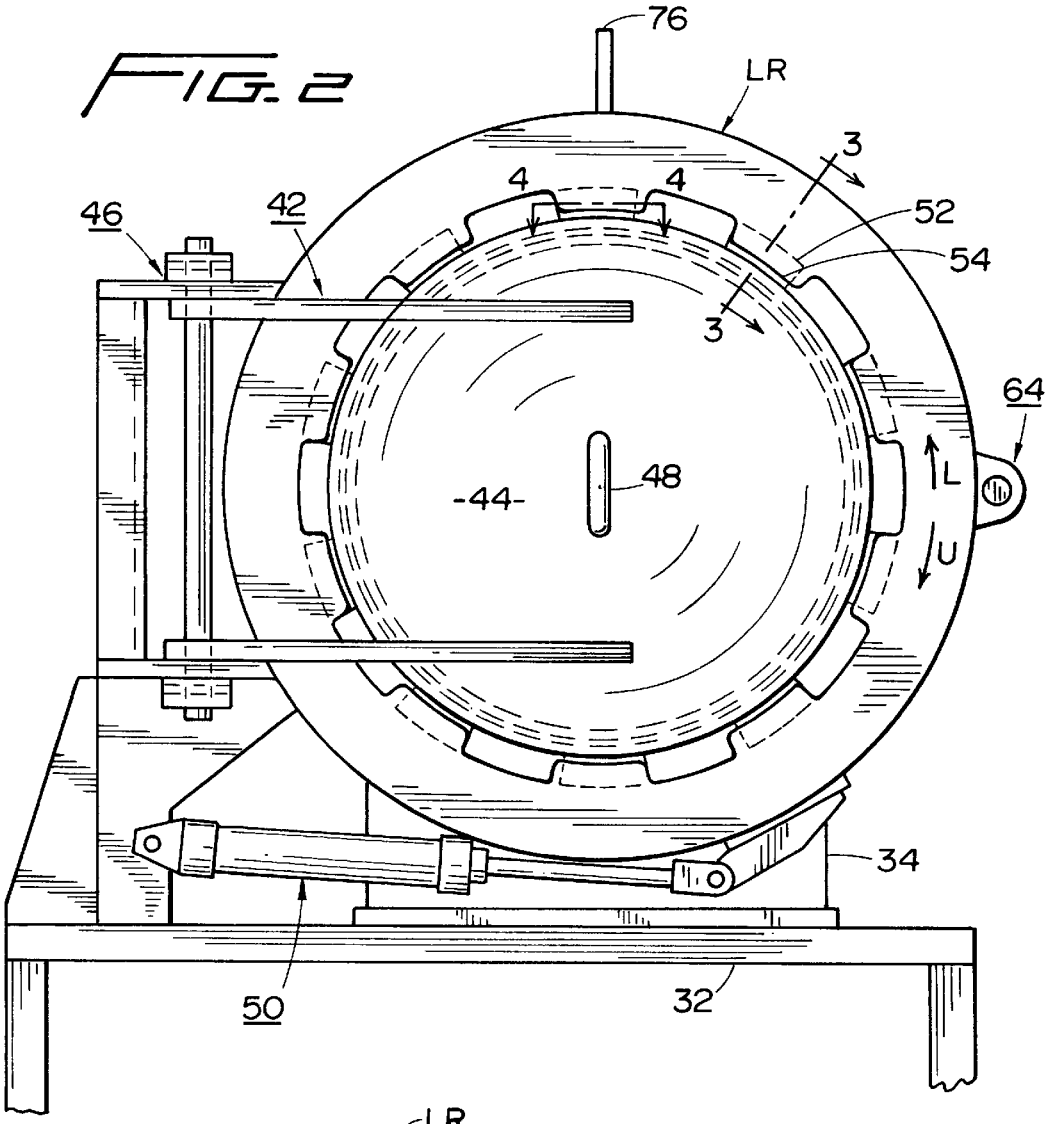
FIG. 2 is an elevational front view of the wash vessel of FIG. 1.

Because the operating pressure within the wash vessel is relatively high (800–1500 psig), the door 44 is fastened very securely in its closed position. This is accomplished by a locking ring LR that is rotated hydraulically by a piston and cylinder assembly 50. As shown in FIG. 2, rotation of the locking ring in the direction indicated by arrow L locks the ears 52 of the door inside of the ears 54 of the locking ring, and rotation of the locking ring in the direction of the arrow releases the door ears 52 from engagement with the ring ears 54.

Figure 3:
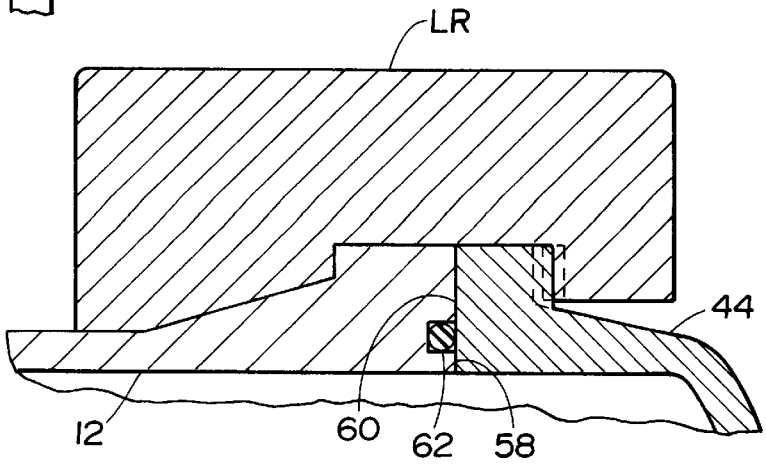
FIG. 3 is a fragmentary sectional view taken along lines 3—3 of FIG. 2 and showing details of features for securing the wash vessel door.
Figure 4:
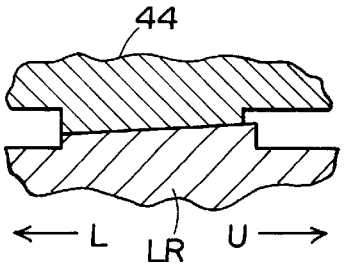
FIG. 4 is a fragmentary sectional view taken along lines 4—4 of FIG. 2 and showing additional details of features for securing the wash vessel door.
Figure 5:
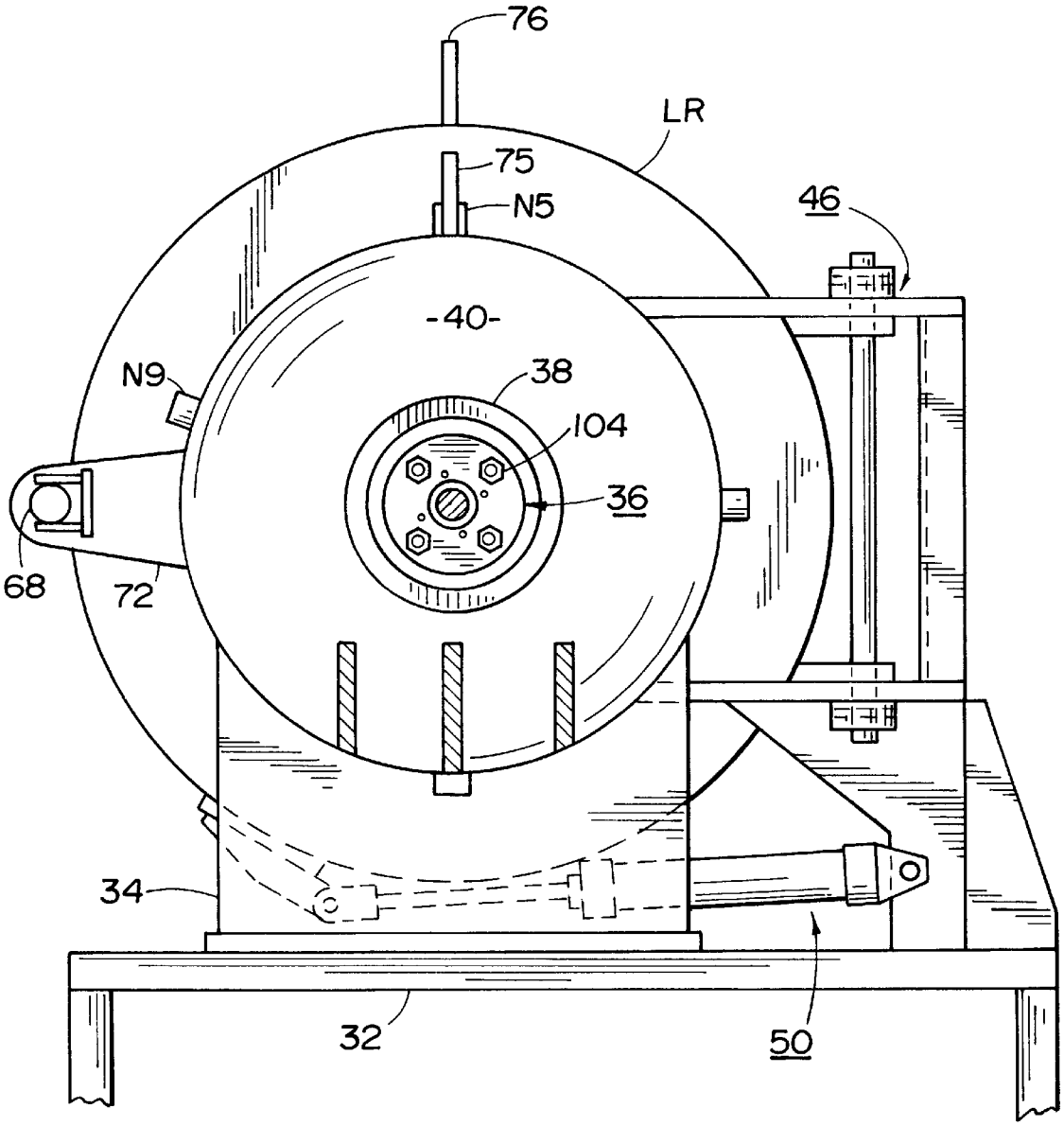
FIG. 5 is an elevational rear view in partial section taken along line 5—5 of FIG. 1.

As shown in more detail the cross sections of FIGS. 3 and 4, the door ears 52 and the ring ears 54 have respective wedge surfaces 53 and 55 that are sloped in opposite arcuate directions relative to a radial plane. A cooperative sliding engagement between these wedge surfaces causes opposing faces 58 and 60 on the door and vessel sidewall, respectively, to compress an O-ring seal 62 extending around the entire periphery of the door and the vessel opening that it closes when the locking ring is in its locked position.

To firmly secure the locking ring LR in its locked position, a locking pin assembly 64 is provided on the exterior of vessel sidewall 12 for laterally inserting a locking pin LP through the aperture of an ear 66 welded to the outer surface of the locking ring. The extension of the locking pin into, and its withdrawal from, the aperture of ear 66 is preferably carried out by means of an hydraulic cylinder 68 having a piston 69 connected to the proximate end of locking pin LP to provide reciprocal sliding movement of the pin within a sleeve 70 mounted on the side of vessel WV by a pair of brackets 72, 73.

The wash vessel is also provided with a rupture disk 41 capable of rupturing to prevent over-pressurization of the closed pressure vessel substantially before fluid pressure within the vessel approaches the design pressure of the vessel. In addition, numerous coupling nipples provide inlet and outlet ports through the sidewall 12 of the wash vessel. These coupling nipples include liquid $CO_2$ inlet and outlet ports N1 and N2, co-solvent inlet port N3, purge gas inlet port N4, vent gas outlet port N5, pressure release port N6, differential pressure measuring ports N7 and N8 for measuring liquid level in the wash vessel, and pressure gauge port N9 for measuring internal wash vessel pressure. Additional coupling nipples may be provided as needed for instrumentation. For example, although all of these ports are not shown in FIG. 1, sets of four or more ports each may be provided at about 90° intervals around the circumference of the wash vessel. The wash vessel WV may also be provided with a pair of lifting lugs 75, 75 for placement and removal of the wash vessel relative to the base 32, and the locking ring LR may be provided with a lifting lug 76 for placement and removal of the locking ring relative to the wash vessel during its assembly.

The structural details of the seal assembly 36 will now be described with reference to FIGS. 6 and 7. A cylindrical sleeve 80 is secured around an intermediate segment of the drive shaft 18 by means of a locking ring 81 held in place by a plurality of circumferentially spaced set screws 82. A rotary seal ring 84 is secured for rotation with the shaft 18 and the sleeve 80 by means of one or more sleeve keys 86 received in corresponding key ways of ring 84. A rotationally stationary seal ring 88 has a radial face biased against a radial face of rotary seal ring 84 at an interface 89 by a first slide assembly that includes an annular ring 90 having a plurality of cups each for receiving a compressed coil spring 92 for causing axial sliding movement of the rotationally stationary seal ring 88 relative to a nose piece 94 and a base piece 95. The engaged radial faces of seal rings 84 and 88 form a barrier seal at interface 89 between a wash fluid WF in a vessel passage 98 and a sealant fluid SF fed into the seal assembly 36 by a radial passage 100 in an outer gland member 102 secured to the vessel head piece 38 by a plurality of bolts 104. An annular compression seal 106 of a resilient material is compressed between the nose piece 94 and the head piece 38 by the gland member 102 upon tightening of the bolts 104.

A second rotary seal ring 108 is secured by a key 110 for rotation with the shaft 18 and the sleeve 80, and is secured in place axially by a collar 112 and a backup ring 114. A radial face of second seal ring 108 is slidingly engaged at an interface 117 by an opposing radial face of a second rotationally stationary seal ring 116 that is part of a second slide assembly. Stationary seal ring 116 is arranged to slide axially and is biased toward rotary seal ring 108 by a second spring assembly 118, which includes a plurality of springs 120 and a pusher member 122, the sliding movement of which is guided by a plurality of pins 124. The springs 120 and the pins 124 are held in position by an annular base member 126 that is secured in place by a plurality of clips 128 each fixedly secured to the lock ring 81 by a cap screw 130. The base member 126 is clamped in a counterbore of gland member 102 by a plurality of button head screws 132. The cap screws 130 permit some radial adjustment of the components whose radial position depends on the radial position of base member 126, the adjusted position then being fixed by the tightening of button head screws 132.

The abutting radial faces of seal rings 84 and 88 and of seal rings 108 and 116 create therebetween a sealant chamber 101 in communication with the sealant fluid passage 100 and both the sealant chamber and the sealant passage are pressurized, preferably to a pressure between 500 and 600 psig below the pressure of the wash fluid WF in the wash chamber 14 of the wash vessel WV. With respect to the ambient pressure outside of the stationary seal ring 116, the pressure of the sealant fluid SF in chamber 101 should not exceed this ambient pressure by more than about 500 psig. This is because the interface 89 and the interface 117 are each capable of preventing leakage thereacross of the higher pressure fluid at differential pressures of up to about 600 psig.

The sealant fluid SF may be a proprietary product available under the name ISOPAR from the Dupont Chemical Co. This same ISOPAR product may also be used as the co-solvent component of the wash fluid, which is a mixture of the liquid $CO_2$ component (primary solvent) and the co-solvent component as described in more detail below. However, other liquids may be used as the co-solvent and as the sealant fluid, and the co-solvent liquid may be the same as or different from the sealant liquid. For example, the co-solvent and the sealant may be the same or different liquid surfactants, such as those currently available from Micell Technologies or Dupont Chemical Company.

Figure 6:
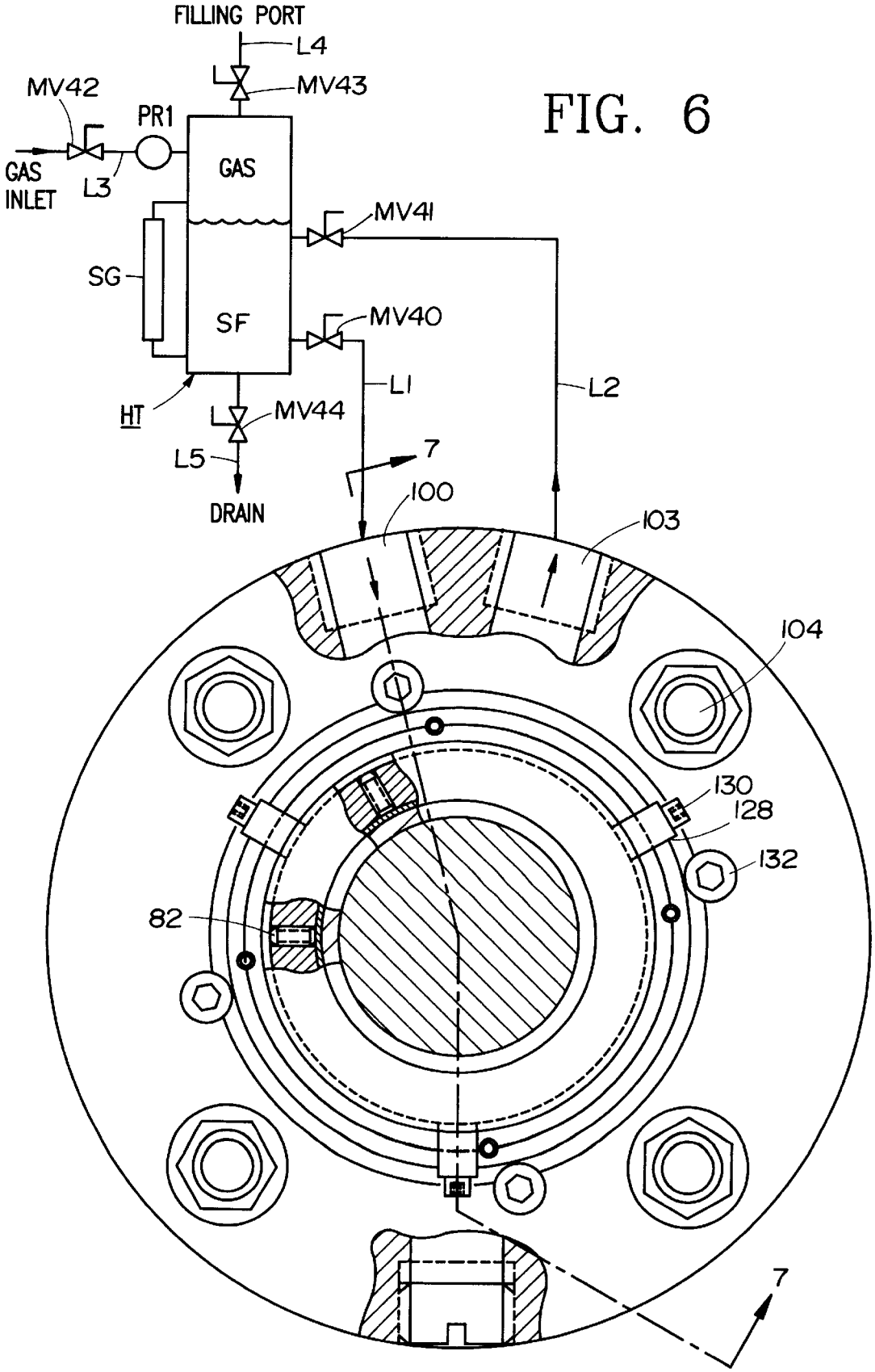
FIG. 6 is a sectional view taken along line 6—6 of FIG. 1 showing fragmentary sections of details of the drive shaft seal mechanism, and illustrating a fluid system for supplying fluid to the seal mechanism.
Figure 7:
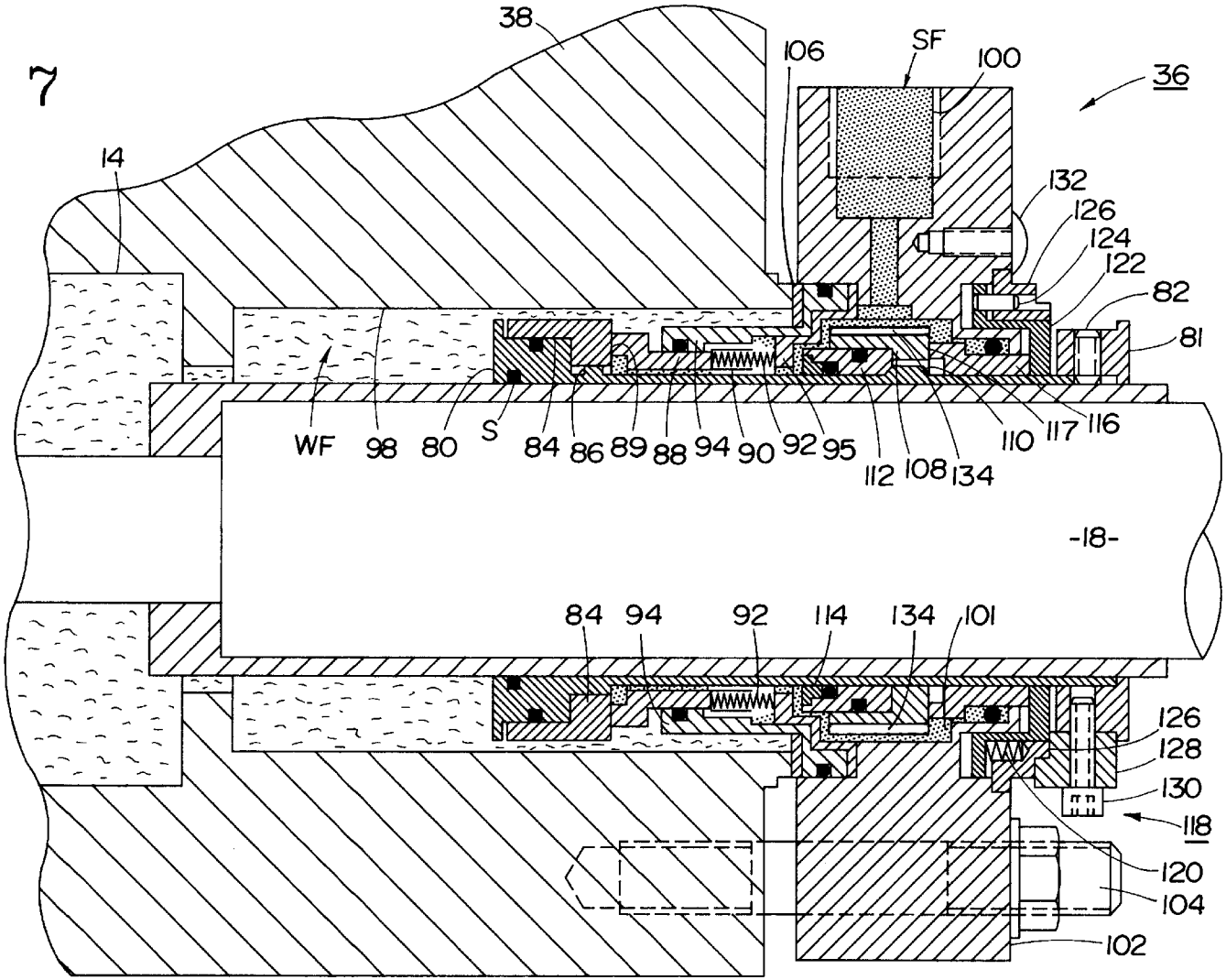
FIG. 7 is a sectional view of the drive shaft seal mechanism as taken along line 7—7 of FIG. 6.

As shown by the diagrammatic portion of FIG. 6, the sealant fluid SF is supplied to the inlet passage 100 from a holding tank HT via a supply line L1 containing a manual ball valve MV40. After entering passage 100, the sealant fluid is pumped into sealant chamber 101, around the shaft sleeve 80, and into an outlet passage 103 by a plurality of vanes 134 spaced at equal intervals around the other periphery of rotary seal ring 108. From the outlet passage 103, the sealant fluid is returned to holding tank HT via a line L2 containing a manual ball valve MV41.

The sealant fluid SF is maintained at an elevated pressure, preferably about 250–300 psig by a pressurized gas, preferably $CO_{21}$ which is introduced into the upper portion of tank HT via a gas inlet line L3 containing a manual ball valve MV42 and an optional pressure regulator PR1. PR1 is optional because it may be eliminated if gas inlet line L3 is connected to the bulk gas storage tank BT of FIG. 8 in which the gas pressure is usually at about 300 psig. Holding tank HT is also connected to a sealant fill line L4 containing a manual ball valve MV43, and to a sealant drain line L5 containing a manual ball valve MV44. A sight gauge SG is preferably connected to tank HT for indicating the level of liquid sealant within the tank.

Figure 8:
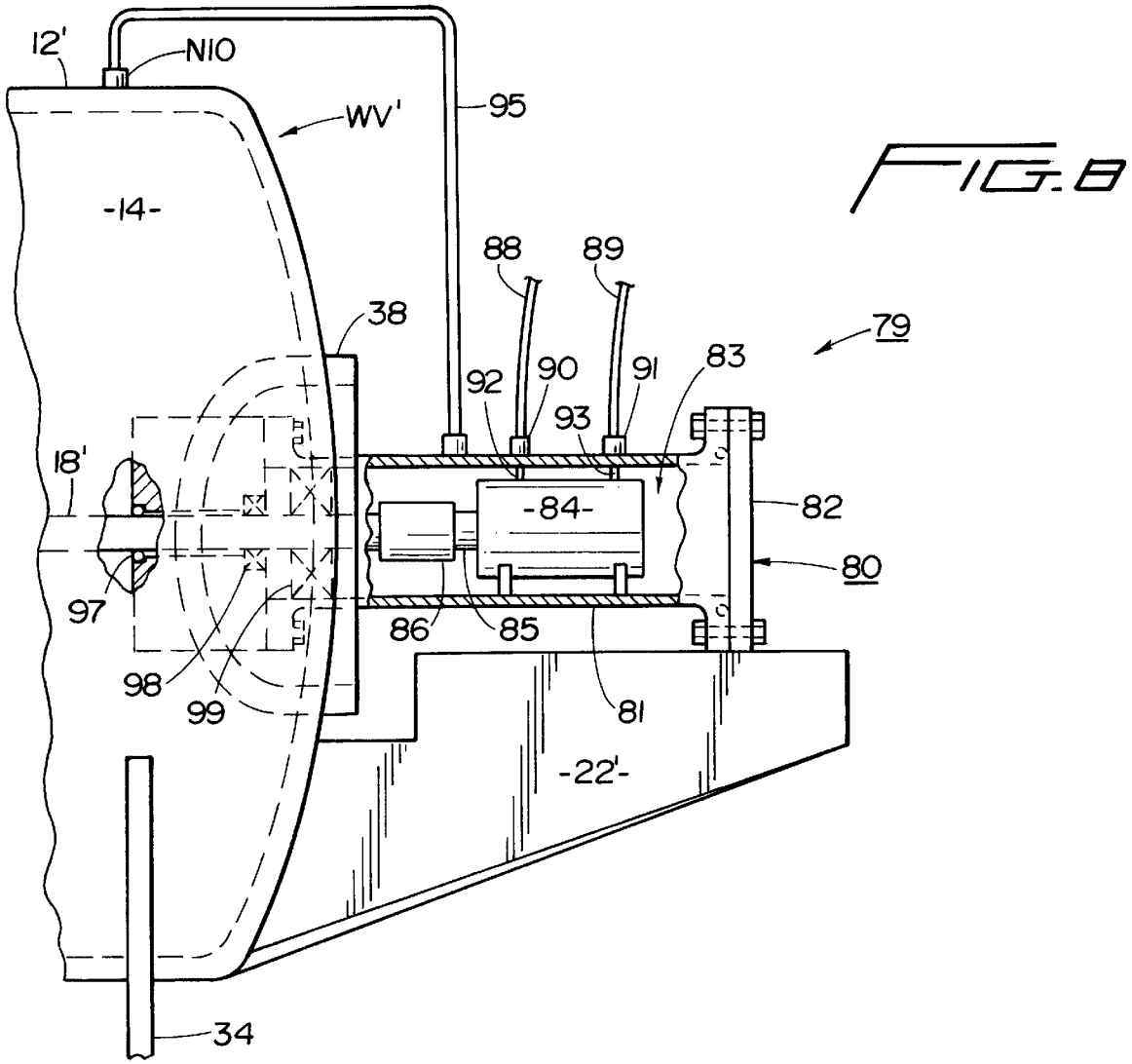
FIG. 8 is a diagrammatic view illustrating modified drive and seal mechanisms for the wash vessel of FIG. 1.

Referring now to FIG. 8, there is shown a modification of the wash vessel of the invention wherein the seal assembly 36, the external drive shaft 18, the external motor M5, and the related drive and bearing components, are replaced by a hydraulic motor assembly 79 comprising a sealed casing 80 having a cylindrical sidewall 81 and an outer end closure 82 defining a drive chamber 83 in which is mounted a hydraulic motor 84. The casing 80 is supported on the vessel mounted platform 22'. A motor shaft 85 is connected by a coupling 86 to a drive shaft 18' for rotating the tumbler basket in the wash vessel WV'. The hydraulic motor 84 is driven by a flow of hydraulic fluid from an external hydraulic pump (not shown) recirculated through an inlet line 88 and an outlet line 89. Although hydraulic lines 88 and 89 may be either flexible or rigid, they are secured to rigid fittings 90 and 91 forming ports in the high pressure casing 80 that are connected to hydraulic motor 84 via rigid tubing 92 and 93, respectively.

The design strength of casing 80 is sufficient to withstand the same internal pressure as the wash vessel WV', and drive chamber 83 is in fluid communication with wash chamber 14 through a pressure equalization line 95 connected to a high pressure coupling nipple N10 as shown in FIG. 8. Since the fluid pressure in drive chamber 83 and wash chamber 14 are substantially equal, the modification of FIG. 8 eliminates the need for the special seal assembly 36, which must be designed to withstand relatively large differential pressures as described above. Drive chamber 83 therefore also serves as a sealant chamber in place of sealant chamber 101.

Thus, the modified drive system of FIG. 8 is enclosed inside a pressure boundary constituting an extension of the pressure boundary of the wash vessel such that there is substantially no differential pressure across the seal 97, which therefore may be of conventional design to prevent contaminants from the wash chamber 14 from entering the drive chamber 83. Since the coupling N10 penetrates the sidewall 12' of the wash vessel WV' at the top of the wash chamber 14, only gaseous $CO_2$ enters the drive chamber 83 through the equalization line 95.

Figure 9:
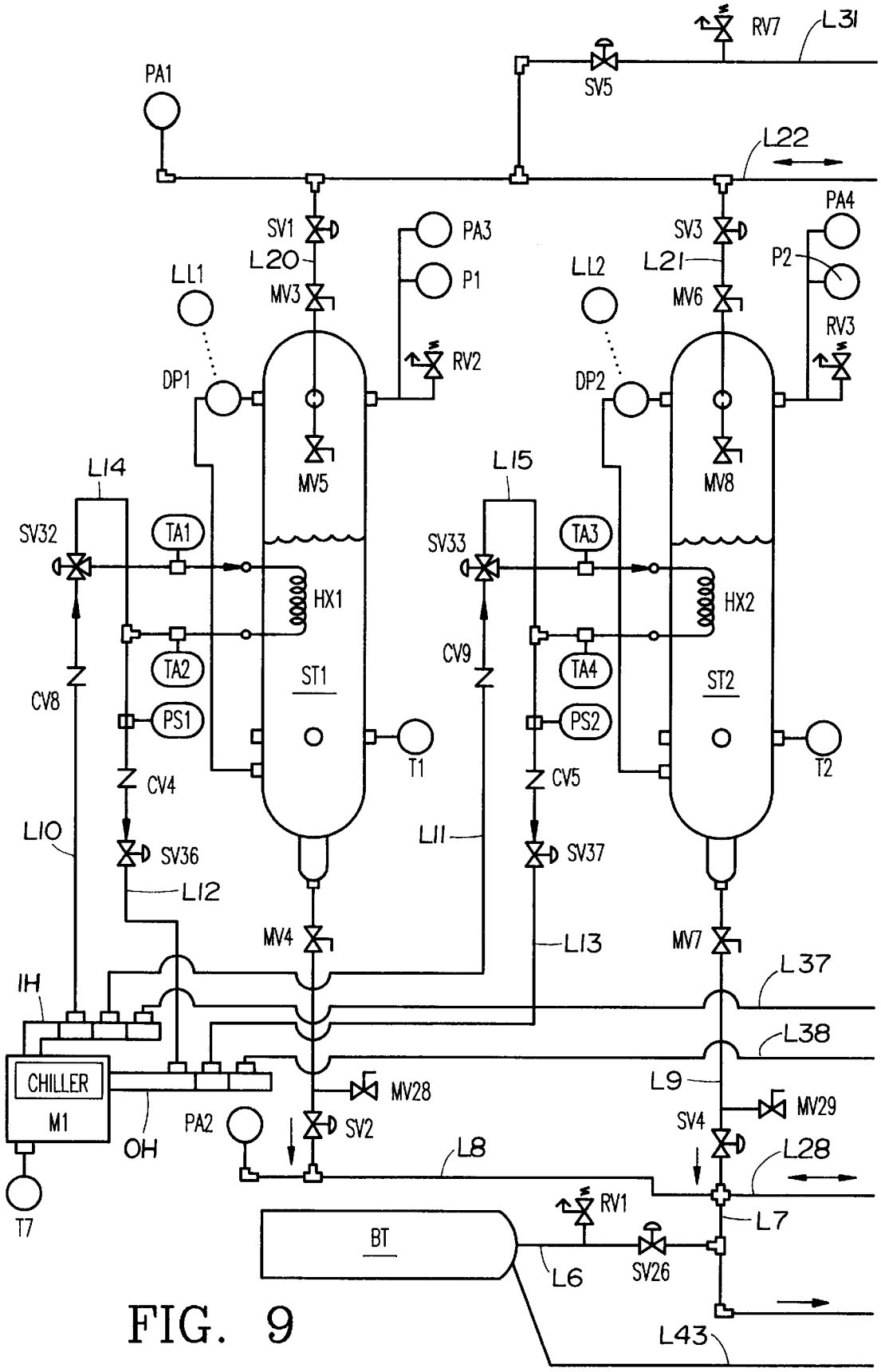
FIGS. 9–11 are consecutive segments of a flow diagram illustrating the fluid systems and components for supplying cleaning fluid to and removing cleaning from the wash vessel of FIG. 1.
Figure 10:
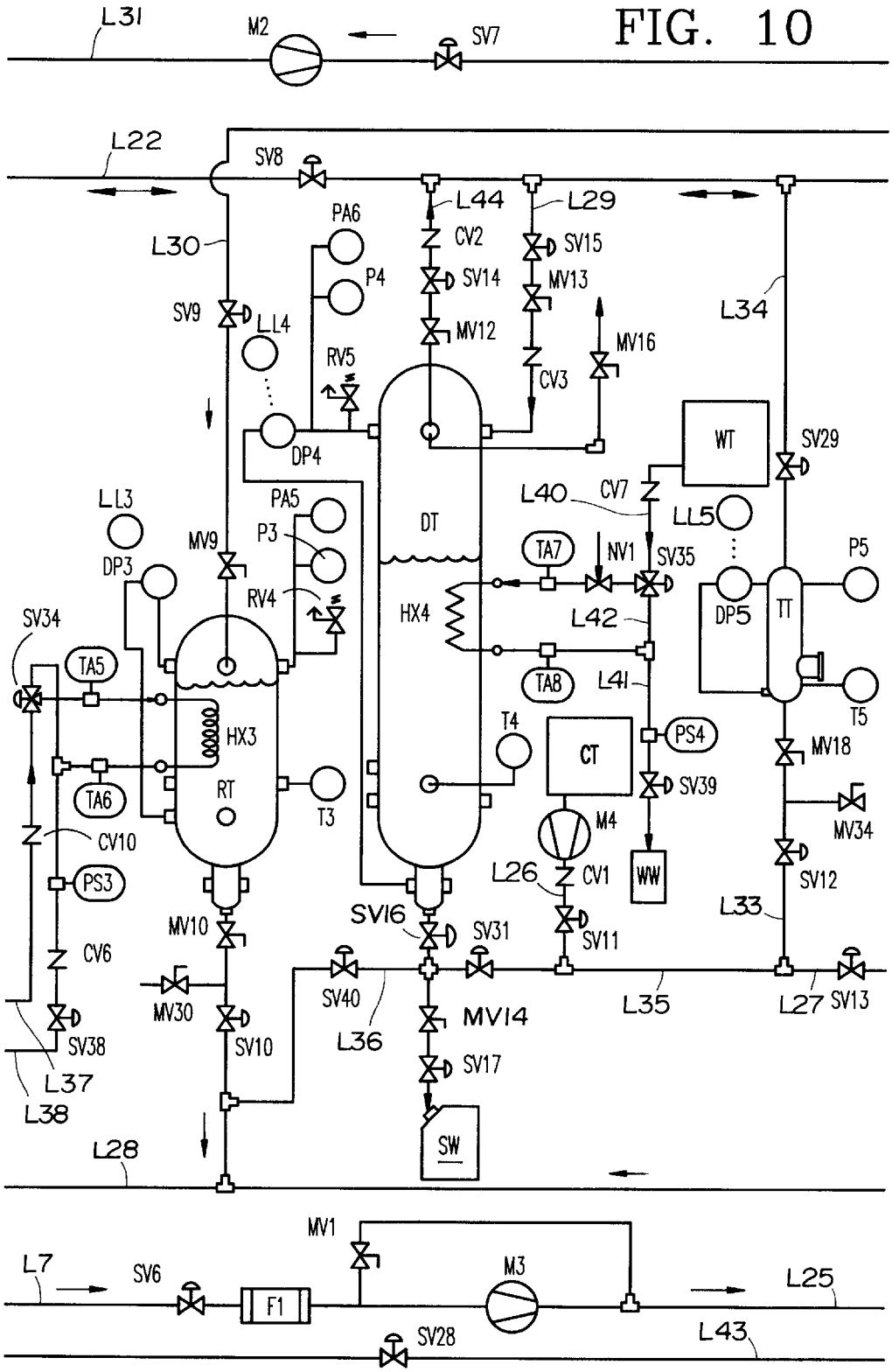
Figure 11:
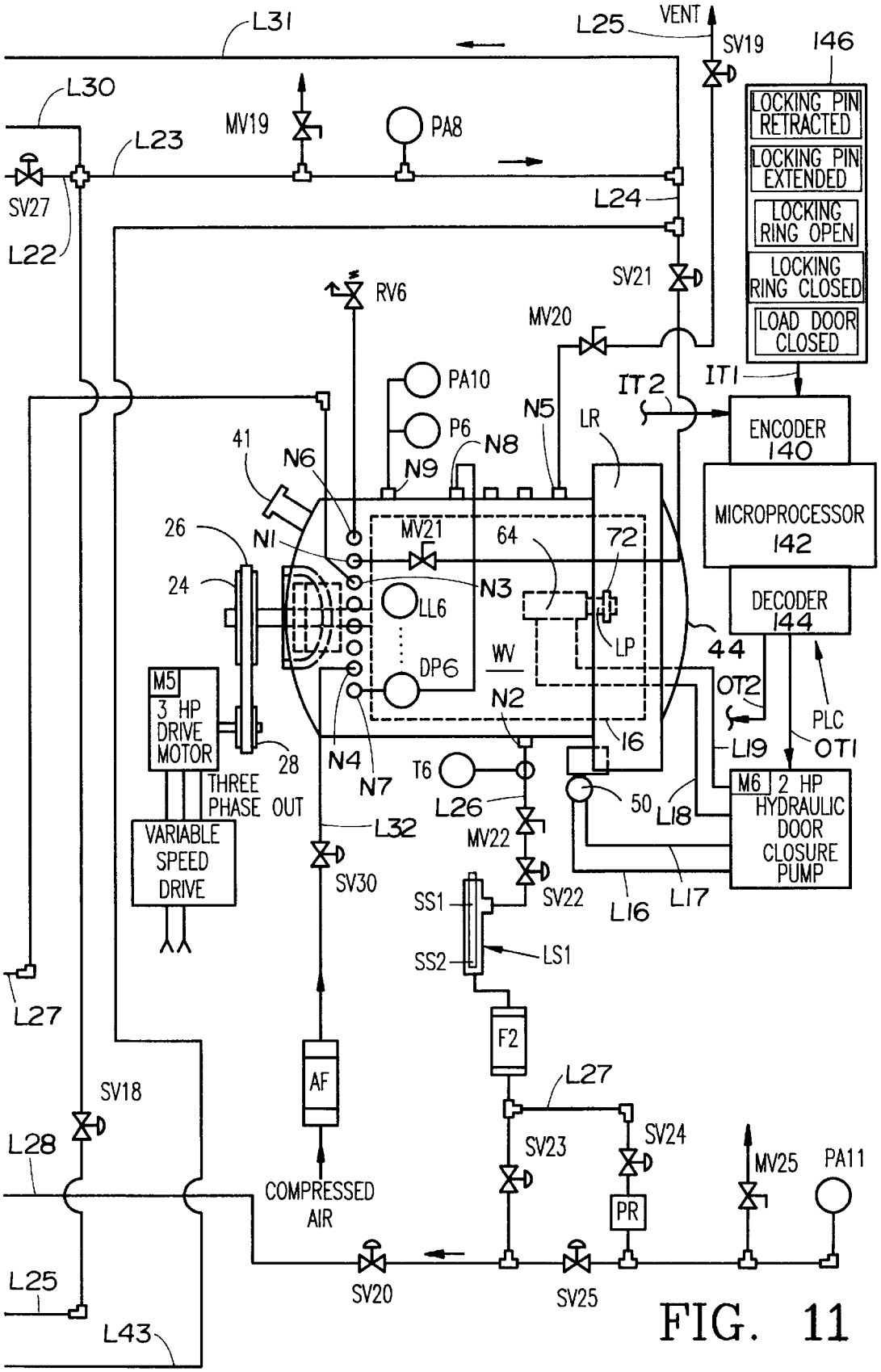

In FIGS. 9–11 are shown the primary components and fluid systems for supplying and removing the cleaning fluid used in the wash vessel WV. The cleaning fluid may comprise a liquid primary solvent and co-solvent mixture and a pressurized gas, and the liquid phase may also include a surfactant. The solvent and co-solvent mixture may be a mixture of liquid $CO_2$ and liquid ISOPAR, the pressurized gas may be gaseous $CO_2$, and the surfactant may be one or more surfactant compositions provided by Micell Technologies.

The system storage tanks ST1 and ST2 are initially filled with liquid $CO_2$ from a bulk storage tank BT containing carbon dioxide at a temperature of about 0° F. and a pressure of about 300 psig, utilizing lines L6, L7, L8 and L9. Solenoid valves SV26, SV2 and SV4 are then closed and tanks ST1 and ST2 are heated to about 70° F. by heat exchangers HX1 and HX2, thereby raising the fluid pressure to about 850 psig. Tanks ST1 and ST2 preferably have a capacity of about 100 gallons each where the capacity of the wash vessel WV is also about 100 gallons. The heat exchangers HX1 and HX2 receive heat exchange fluid from a chiller having a cyclically operated motor M1, and an inlet header IH and an outlet header OH. The heat exchange fluid is preferably an ethylene glycol and water solution. Inlet header IH is connected to the respective heat exchanger inlets via lines L10 and L11, and outlet header OH is connected to the respective heat exchanger outlets via lines L12 and L13. Inlet line L10 contains a three-way solenoid SV32 and may be connected to outlet line L12 via a by-pass line L14, and inlet line L11 contains a three-way solenoid valve SV33 and may be connected to outlet line L13 via a by-pass line L15, so that the respective heat exchangers HX1 and HX2 may be by-passed to allow the temperature in each tank to be adjusted more precisely while the chiller motor is running to serve the other tank or the rinse fluid holding tank RT.

After the tanks ST1 and ST2 have reached the desired operating temperature and pressure, the wash vessel WV may be operated for the dry cleaning of clothes or other articles. For this purpose, appropriate outputs represented by arrow OT1 are made from the programmable logic controller PLC to the controller of the hydraulic pump and motor unit M6 to sequentially withdraw the locking pin LP from ear 72 and rotate the locking ring to its unlocked position so that the vessel door 44 may be opened and articles placed into the tumbler basket 16 for cleaning. After the tumbler basket is loaded, the door 44 is closed, the locking ring LR is rotated to its locked position, and the locking pin LP extended through the aperture of the locking ear 72 to seal and lock the wash chamber 14 before it is pressurized.

The required rotation of the locking ring and the required retraction and extension of the locking pin is provided by the locking ring piston and cylinder assembly 50, the locking pin piston and cylinder assembly 64 and the hydraulic door closure pump and motor unit M6, which is under the control of the programmable logic controller PLC. Assembly 50 is connected to the hydraulic pump via lines L16 and L17, and assembly 64 is connected to the hydraulic pump via lines L18 and L19 as shown in FIG. 10. Two pressure switches (not shown) are installed in respective ports of the wash vessel WV to prevent operation of hydraulic pump M6 if the pressure in the vessel WV is above atmospheric.

The logic controller PLC comprises an encoder 140, a microprocessor 142 and a decoder 144. Encoder 140 receives inputs represented by arrow IT1 from a sensor array 146, which comprises locking pin retracted and extended sensors, locking ring open and closed sensors and a load door closed sensor. Encoder 140 receives additional inputs represented by arrow IT2 from all of the solenoid valves and temperature and pressure instrumentation shown in FIGS. 9–11 and described below. Controller PLC also receives via encoder 140 programming inputs from a keypad (not shown) whereby the respective washing and/or rinsing cycles and the time periods for each of these operations are selected. In addition to the output OT1 to the door operating unit M6, decoder 144 sends additional outputs represented by arrow OT2 to all of the motor units and solenoid valves, as also shown in FIGS. 9–11 and described below, to accomplish the selected operations.

After the vessel door 44 is closed and sealed, the fluid system valves are lined up to purge air from the system with $CO_2$ gas. To accomplish this, solenoid valves SV1, SV3, SV8, SV19, SV21 and SV27 are opened for about two seconds so that $CO_2$ gas from tanks ST1 and ST2 is fed to the wash vessel through lines L20, L21, L22, L23 and L24, and air is vented from the wash vessel through line L25. After two seconds, valve SV19 closes and the wash vessel continues to pressurize through line 24 until the vessel pressure equalizes with the storage tank pressure at about 850 psig.

Solenoid valves SV1, SV3, SV8, SV21 and SV27 are now closed so that liquid $CO_2$ may be fed from the bottom of the storage tanks ST1 and ST2, or from the bottom of the rinse fluid holding tank RT (if the preceding wash operation included a rinse cycle as explained further below). To feed liquid $CO_2$ from storage tanks ST1 and ST2, solenoid valves SV2, SV4, SV6, SV18 and SV21 are opened and the liquid $CO_2$ pump M3 is run until the level in the wash vessel is about 40% of its total volume as determined by the controller PLC based on vessel temperature and pressure. With the valve line up just described, liquid $CO_2$ flows through lines L8, L25, L23 and L24 and into the wash vessel WV. When the liquid volume reaches about 40%, valves SV2, SV4, SV6, SV18 and SV21 are closed, and pump M3 is stopped. Unheated liquid $CO_2$ also may be introduced into the wash vessel directly from bulk storage tank BT via a direct feed line L43 containing a solenoid valve SV28.

A co-solvent storage tank CT contains the co-solvent, such as the seal lubricant ISOPAR, and a surfactant, such as a surfactant available from Micell Technologies, Inc. This mixture, which will be referred to generically hereafter as the "co-solvent", is pumped into the wash vessel WV via a metering pump M4 until the level in the wash vessel has increased by 5% of the total volume, i.e., until the total liquid volume in the wash vessel has reached about 45%. This co-solvent addition is made through lines L26 and L27 by first opening and then closing solenoid valves SV11 and SV13, and running pump M4 only while these valves are open.

At this time, the drive motor MS is started to rotate the tumbler basket 16 inside of the wash vessel. As the tumbler is rotated, solenoid valves SV6, SV18, SV20, SV21, SV22, SV24 and SV25 are opened, and the pump M3 is operated so that the wash fluid is recirculated through the wash vessel for a wash cycle, which may be about five to ten minutes in duration but could be longer or shorter depending on the type of articles and the amount and type of contamination to be removed from them. This re-circulating flow is through a line L26 containing a level sensor LS1 and a filter F2, a line L27 containing an activated carbon purifier PR, line L28, line L7, line L25 containing a filter F1 and pump M3, and lines L23 and L24. At the end of the wash cycle, the motor M5 is turned off to stop rotation of the tumbler 16, and the pump M3 is shut off and the valve SV21 is closed to stop recirculation of the wash fluid.

At this point, the wash vessel is drained of liquid wash fluid by opening solenoid valve SV15 and SV27 and running pump M3, such that the liquid wash fluid is pumped from the wash vessel into the top of wash fluid distillation tank DT through lines L26, L27, L28, L25, L23 and L29. Pump M3 is run until the low level sensor SS2 of the level sensor LS1 shows a gas instead of a liquid in line L26.

Pump M3 is then turned off and either a spin cycle or a rinse cycle is run, depending on whether the rinse mode was selected by the operator at the keypad for the controller PLC. It is also possible to run a rinse cycle preceded and/or followed by a spin cycle. If only the spin cycle has been selected, the wash operation would skip the rinse cycle and go directly to the spin cycle described below after the rinse cycle.

If a rinse cycle is selected to take place before the spin cycle, solenoid valves SV2, SV4, SV6, SV18 and SV21 are opened, and pump M3 is run to fill the wash vessel to a volume of approximately 30 percent with liquid $CO_2$ from storage tanks ST1 and ST2 through lines L8, L9, L25, L23 and L24. When the volume has reached 30 percent, pump M3 is shut off, solenoid valves SV2 and SV4 are closed, and solenoid valves SV20, SV22, SV24 and SV25 are opened. Pump M3 is then re-started so that liquid $CO_2$ is recirculated through lines L26, L27, L28, L25, L23 and L24. Motor M5 is then run for about two to about five minutes si as to rotate the tumbler basket 16 as in the wash cycle. At the end of the rinse cycle, pump M3 and motor M5 are shut off and solenoid valve SV21 is closed. Solenoid valve SV9 is then opened and pump M3 run to pump the used rinse fluid from the wash vessel to the rinse storage tank RT through lines L26, L27, L28, L25, L23 and L30.

When the foregoing rinse cycle is utilized, the rinse fluid pumped to rinse tank RT is much cleaner than the wash fluid pumped to distillation tank DT. Therefore, where a rinse cycle has been utilized, the wash fluid (liquid $CO_2$ and co-solvent) for the next wash cycle preferably is taken from the rinse tank RT instead of from the storage tanks ST1 and ST2. For this purpose, solenoid valve SV10 is opened and closed in place of solenoid valves SV2 and SV4 for the filling of the wash vessel for the next wash cycle. The temperature of the used rinse fluid held in tank RT is maintained by heat exchanger HX3 connected to the chiller M1 via an inlet line L37 and an outlet line L38, inlet line L37 containing a 3-way solenoid valve SV34 for routing the exchanger fluid either through heat exchanger HX3 or a bypass line L39.

For a spin cycle following either a rinse cycle, or a wash cycle without a consecutive rinse cycle, motor M5 is run to rotate the tumbler basket 16 at about 200 RPM to aid in removing any residual wash fluid from the articles being cleaned. If the run-off from this spin cycle is great enough to trigger the high level switch SS1 of the level sensor LS1, then the pump M3 will start again to drain off this excess liquid and transfer it to either the rinse tank RT or the distillation tank DT. At the end of the spin cycle, pump M3 is shut off and solenoid valves SV15 and SV27 are closed.

After used wash fluid is transferred to distillation tank DT, the distillation process is then begun for the separation of dirt and other contaminants, as well as the co-solvent, from the primary solvent (liquid $CO_2$) and for recovery of the distilled primary solvent in storage tanks ST1 and ST2. With the chiller M1 turned on and tanks ST1 and ST2 at about their nominal temperature of 70° F., solenoid valves SV1, SV3, SV8 and SV14 are opened to place the top of tank DT in communication with the tops of tanks ST1 and ST2 through lines L44, L22, L20 and L21. Thereafter, a flow of hot water or steam is caused to flow to the heater exchanger HX4 in tank DT by opening solenoid valves SV35 and SV39. The hot water or steam condensate leaving heat exchanger HX4 may be either discharged as waste water or recycled to a boiler WW.

As the primary solvent boils away in tank DT, the dirt, co-solvent and surfactant from the wash fluid remains in the liquid phase in the lower portion of the tank DT. After substantially all of the primary solvent has boiled away and been recovered as condensate in tanks ST1 and ST2, the solenoid valve SV14 is closed to isolate tank DT, and solenoid valve SV35 in inlet line L40 and solenoid valve SV39 in outlet line L41 are closed to stop the flow of hot water and/or steam through heat exchanger HX4. Solenoid valve SV35 is a 3-way solenoid valve for routing the heating fluid either through heat exchanger HX4 or through a bypass line L42, allowing precise control of the amount of heat input to tank DT. The dirt fraction from the wash fluid then settles to the bottom of tank DT from where it is discharged into a solid waste container SW by the cycling of solenoid valves SV16 and SV17.

The liquid then remaining in tank DT comprises a co-solvent and surfactant fraction that may be used in a subsequent wash cycle in place of fresh co-solvent and surfactant from tank CT, by opening solenoid valve SV31 instead of valve SV11 at the appropriate time during filling of the wash vessel with the wash fluid. If the existing differential pressure is not sufficient to accomplish this transfer, solenoid valve SV40 is opened instead of solenoid valve SV31 and pump M3 is used to accomplish this transfer with a valve lineup similar to that for transferring rinse fluid from tank RT.

As an alternative to transferring co-solvent and surfactant to the wash vessel directly from either the co-solvent tank CT or from the bottom of distillation tank DT, the desired amount of co-solvent and surfactant may be introduced first into a co-solvent transfer tank TT from either tank CT or tank DT. For example, since the bottoms from the tank DT may not be in a sufficient amount, these bottoms may be transferred to tank TT and the balance of the desired amount of co-solvent made up from co-solvent tank CT, with the respective amounts inputted to tank TT being measured is by the differential pressure detected by a digital sensor DP5 indicated on a level indicator L5. The contents of tank TT may then be transferred to the wash vessel by opening solenoid valve SV12 in line L33 and solenoid valve SV29 in line L34, and then either opening valve SV13 and using differential pressure and line L27, or opening valves SV31 and SV40 and using pump M3 to make the transfer.

After the wash and spin cycles (or the wash cycle without a spin cycle) are completed, the wash vessel is reduced in pressure for removal of the cloths or other washed articles. In order not to waste pressurized $CO_2$ gas by venting it to the atmosphere, solenoid valve SV1, SV3, SV5, SV7 and SV21 are opened and the gas compressor M2 is run to transfer CO2 gas from the wash vessel and feed it as a liquid to the storage tanks ST1 and ST2 through lines L24, L31, L22, L20 and L21. When the wash vessel pressure is reduced to about 100 psig, compressor M2 is shut off and solenoid values SV1, SV3, SV5, SV7 and SV21 are closed. However, if the distillation cycle is taking place simultaneously with the gas compression cycle, the solenoid valves SV1 and SV3 will remain open until such time as both the gas compression and the distillation cycles are completed.

Thereafter, solenoid valve SV19 is opened to vent off the remaining 100 psig of carbon dioxide gas and from wash vessel. As the vessel pressure approaches atmospheric, solenoid valve SV30 is opened for a minute or so to purge the remaining $CO_2$ gas from the wash vessel by displacing it with compressed air. Valve SV30 is in a compressed air line L32, which also contains an air filter AF and is connected to an appropriate source of compressed air, such as instrumentation air from an air tank or an air compressor (not shown).

The hydraulic pump M6 is then operated to withdraw locking pin LP from ear 72 and the locking ring LR is rotated to its open position to permit wash vessel door 44 to be opened with handle 48 so that the cleaned cloths or other articles may be removed from the tumbler basket 16. The system is now ready to be loaded with the next batch of dirty articles and the wash operation repeated in according with the foregoing process.

However, subsequent wash operations after the first operation will be varied to the extent that the storage tanks ST1 and ST2 do not have to be completely refilled from the bulk storage tank ET, since only about 8 pounds of liquid $CO_2$ have been lost from the system due to venting of the last hundred psig of gaseous $CO_2$ from the wash vessel. The lost $CO_2$ is made up for the next wash cycle just after solenoid valve SV19 is closed following the purge of air from the system. Before the addition of the makeup $CO_2$, the solenoid valves SV1, SV3, SV8 and SV27 are also closed to discontinue the $CO_2$ purge.

The make-up $CO_2$ is then added by precharging the wash vessel with liquid $CO_2$ from the bulk storage tank BT by opening and then closing valve SV28 in line L43. If the liquid level in ST1 and ST2 indicates a liquid volume of 68% or higher, then there is no make up $CO_2$ added to the wash vessel. If the liquid volume is between 50 and 68%, then 100 psig of gaseous $CO_2$ is added to the wash vessel from the bulk storage tank BT. If the liquid volume is less than 50, then 300 psig of gaseous $CO_2$ is added to the wash vessel from the tank BT. After addition of the makeup $CO_2$ from tank BT, solenoid valves SV2 and SV4, or solenoid valve SV10, are opened as appropriate to transfer liquid to the wash vessel from either heated storage tanks ST1 and ST2 or rinse tank RT, and thereby to fill the wash vessel as previously described.

As the function of the remaining hardware shown in FIGS. 9–11 will be self-evident to those skilled in the art, the valves and the temperature and pressure measuring and indicating devices shown in these figures are summarized as follows. SV1 through SV40 are solenoid valves, the operations of which are controlled by controller PLC. Valves MV1 through MV30 are manual ball valves that are normally open during system operations, unless otherwise indicated. PA1 through PA11 are analog pressure gages. P1 through P6 are digital pressure gages. DP1 through DP6 are differential pressure sensors having respective liquid level indicators LL1 through LL6. T1 through T7 are digital liquid temperature indicators each having a corresponding temperature sensor (not shown) in the corresponding tank. TA1 through TA8 are analog temperature gauges. CV1 through CV8 are check valves, NV1 is a manual needle valve for setting heating fluid flow to heat exchanger HX4. RV1 through RV6 are relief valves.

The specific embodiments of the invention as described above are presented by way of examples illustrating the generic concepts of the invention, and not by way of limiting those concepts. Many modifications are possible without departing from the scope of the invention. For example, the system of the invention may be operated with only one solvent storage tank and with less than all of the components shown in FIGS. 9–11. Similarly, the differential pressure seal mechanism illustrated in FIG. 7 may have components of differing shapes and may be constructed with less components than those illustrated by way of example.

In addition, other carbon compounds that are gaseous at ambient conditions and liquid at elevated pressure may be used in place of carbon dioxide, such compounds including methane, ethane, propane, butane, and pentane, either alone or in admixture with a carbon dioxide or each other. Co-solvents and surfactants, other than those described above also may be used. Accordingly, many additional modifications of the invention will occur to those skilled in the art when they learn of the disclosure presented herein. The scope of the invention therefore is not limited to the specific examples described above, but instead is defined by the numbered claims set forth below.

What is claimed is:

1. A system for cleaning an article with a cleaning fluid having a gaseous component and a liquid component comprising a compound of said gaseous component maintained at a pressure sufficiently elevated above atmospheric pressure to keep a portion of said compound in a liquid state, said system comprising:

a pressure vessel having a sidewall defining an opening at one end and having an end wall at another end;

door means for closing said opening to provide a wash chamber pressurizable by said gaseous component;

a basket having apertures for passing said liquid component therethrough and connected to a drive shaft for rotation in said wash chamber, said basket being adapted to hold at least one article for contact with said liquid component, and said drive shaft passing through a passage in the end wall of said pressure vessel;

means for providing said cleaning fluid in said wash chamber at said elevated pressure;

bearing means for rotatably mounting said drive shaft;

drive means for rotating said drive shaft to cause the rotation of said basket; and, seal means in said shaft passage for preventing the cleaning fluid from escaping from said pressure vessel through said shaft passage, said seal means including a first seal component adjacent to said wash chamber and a second seal component outboard of said first seal component to provide a sealant chamber therebetween, and supply means for providing a pressurized sealant fluid in said sealant chamber such that a pressure differential across said first seal component is substantially less than the pressure differential between said elevated pressure and atmospheric pressure.

2. The system according to claim 1, wherein said supply means comprises a source of said sealant fluid, and conduit means for supplying said sealant fluid from said source to said sealant chamber.

3. The system according to claim 2, wherein said sealant fluid is a lubricant for at least one of said seal components.

4. The system according to claim 2, wherein said sealant source comprises a holding tank for holding a supply of said sealant fluid and said conduit means comprises a conduit providing fluid communication between said holding tank and said sealant chamber, wherein said drive shaft passes through both said first seal component and said second seal component, and wherein said sealant fluid is a lubricant for both said first seal component and said second seal component.

5. The system according to claim 4, wherein said first seal component comprises a first rotating seal element fixed to said drive shaft for rotation therewith and a first non-rotating seal element rotationally fixed relative to said wash vessel end wall, and wherein said second seal component comprises a second rotating seal element fixed to said drive shaft for rotation therewith and a second non-rotating seal element rotationally fixed relative to said wash vessel end wall.

6. The system according to claim 5, wherein said sealant fluid is a liquid, wherein one of said first and second rotating seal elements includes radially extending vanes for pumping said sealant fluid from an inlet to an outlet of said sealant chamber, and wherein said chamber inlet is connected to said holding tank by an inlet conduit and said chamber outlet is connected to said holding tank by an outlet conduit.

7. The system according to claim 4, wherein said cleaning fluid further comprises said sealant fluid.

8. The system according to claim 7, wherein said sealant fluid is a lubricant for at least one of said seal components.

9. The system according to claim 4 further comprising a storage tank for supplying said liquid compound to said wash chamber, a distillation tank for vaporizing said liquid compound to separate said liquid compound from contaminants removed from said article by said cleaning fluid, means for transferring contaminated cleaning fluid from said wash vessel to said distillation tank after one wash cycle, and means for recycling said vaporized liquid compound as at least a portion of the cleaning fluid provided in said wash chamber for another wash cycle.

10. The system according to claim 9 further comprising means for providing a rinse fluid in said wash vessel for a rinse cycle following said wash cycle, means for transferring said rinse fluid from said wash vessel to a rinse tank after said rinse cycle, and means for transferring said rinse fluid from said rinse tank to said wash vessel for use as at least a portion of the cleaning fluid for a wash cycle subsequent to said rinse cycle.

11. The system according to claim 10, wherein said door means comprises:

a door member mounted for pivotal movement between an open position allowing access to said wash chamber and a closed position covering said pressure vessel opening; and, locking means for securing said door member to said pressure vessel when said door member is in its closed position, said locking means comprising a locking ring rotatable between an open position disengaged from said door member and a closed position in which said locking ring engages said door member to keep it in its closed position when said wash chamber is pressurized.

12. The system according to claim 11, wherein said locking ring comprises a plurality of ears for engaging a plurality of ears on said door member when said locking ring is in its closed position;

wherein said system further comprises an annular seal member made of compressible material and positioned between opposite peripheral faces of said door member and said pressure vessel; and wherein each of said door member ears has an outwardly facing wedge portion for slidingly engaging an inwardly facing wedge portion on a corresponding one of said locking ring ears during rotation of said locking ring from its open position to its closed position, said sliding engagement providing a wedging action causing compression of said seal member between said ring face and said vessel face to seal said vessel opening against loss of the gaseous component of said cleaning fluid.

13. The system according to claim 12, wherein said locking means further comprises a hydraulic piston and cylinder assembly for rotating said locking ring between its open and closed positions.

14. The system according to claim 11, wherein said locking means further comprises a lock member mounted on one of said locking ring and said pressure vessel, and a locking pin mounted for axial sliding movement on the other of said locking ring and pressure vessel, and a hydraulic piston and cylinder assembly for actuating the axial sliding movement of said locking pin between a locked position engaged with said lock member and an unlocked position disengaged from said lock member.

15. The system according to claim 10, wherein said compound is carbon dioxide.

16. The system according to claim 2, wherein said drive shaft passes through said first seal component but does not pass through said second seal component, wherein said drive means comprises a drive motor mounted in said sealant chamber, wherein said sealant fluid comprises a portion of said gaseous cleaning fluid component supplied to said sealant chamber through said conduit means, and wherein said conduit means comprises a conduit providing fluid communication between said wash chamber and said sealant chamber.

17. The system according to claim 16, wherein said drive motor is a hydraulic motor, and wherein said drive means further comprises inlet means and outlet means for providing a flow of hydraulic fluid to and from said hydraulic motor through a wall of said sealant chamber while preventing leakage of said gaseous cleaning fluid portion through said sealant chamber wall.

18. A method for cleaning an article with a cleaning fluid having a gaseous component and a liquid component comprising a compound of said gaseous component maintained at a pressure sufficiently elevated above atmospheric pressure to keep a portion of said compound in a liquid state, said method comprising:

placing the article to be cleaned in a basket within a wash chamber of a pressure vessel, said pressure vessel having an opening providing access to said basket, and said basket having apertures for passing said liquid component therethrough and connected to a drive shaft rotatable mounted by bearing means for rotating the basket in said wash chamber;

closing the opening of said pressure vessel with a door member to seal said wash chamber;

providing said cleaning fluid in said wash chamber at said elevated pressure;

rotating said drive shaft with a drive means to cause said basket to rotate in said wash chamber, said drive shaft passing through a passage in an end wall of said pressure vessel; and, sealing said drive shaft passage with seal means to prevent said cleaning fluid from escaping from said pressure vessel through said shaft passage, said seal means including a first seal component adjacent to said wash chamber and a second seal component outboard of said first seal component to provide a sealant chamber therebetween, and said sealing step comprising introducing a pressurized sealant fluid into said sealant chamber such that a pressure differential across said first seal component is substantially less than a pressure differential between said elevated pressure and atmospheric pressure.

19. The method according to claim 18 further comprising:

supplying said liquid compound to said wash chamber from a storage tank;

transferring contaminated cleaning fluid from said wash vessel to a distillation tank after a wash cycle;

separating said liquid compound from contaminants removed from said article by said cleaning fluid by vaporizing said liquid compound in said distillation tank;

condensing said vaporized liquid compound in said storage tank; and recycling said condensed liquid compound from said storage tank to said wash vessel such that at least a portion of the cleaning fluid provided in said wash chamber for another wash cycle comprises said condensed and recycled liquid compound.

20. The method according to claim 18 further comprising:

providing a rinse fluid in said wash vessel for a rinse cycle following a wash cycle;

transferring said rinse fluid from said wash vessel to a rinse tank after said rinse cycle; and transferring said rinse fluid from said rinse tank to said wash vessel for use as at least a portion of the wash fluid for another wash cycle after said rinse cycle.

21. The method according to claim 18, wherein said compound is carbon dioxide.

* * * * *